US007823892B2

(12) United States Patent
Olson et al.

(10) Patent No.: US 7,823,892 B2
(45) Date of Patent: Nov. 2, 2010

(54) SNOWBOARD

(75) Inventors: Mike Olson, Port Angeles, WA (US); Peter Saari, Seattle, WA (US)

(73) Assignee: Quiksilver, Inc., Huntington Beach, CA (US)

( * ) Notice: Subject to any disclaimer, the term of this patent is extended or adjusted under 35 U.S.C. 154(b) by 125 days.

(21) Appl. No.: 11/744,509

(22) Filed: May 4, 2007

(65) Prior Publication Data

US 2008/0272575 A1 Nov. 6, 2008

(51) Int. Cl.
*A63C 5/04* (2006.01)

(52) U.S. Cl. ..... 280/14.22; 280/602

(58) Field of Classification Search ..... 280/14.22, 280/602, 609, 87.042; 441/68
See application file for complete search history.

(56) References Cited

U.S. PATENT DOCUMENTS 2,181,391 A * 11/1939 Burgeson et al. ..... 280/18
2,253,012 A * 8/1941 Benner et al. ..... 280/842
3,111,695 A * 11/1963 Kelly, Jr. ..... 441/74
3,134,992 A * 6/1964 Tyll ..... 441/70
4,608,023 A * 8/1986 Williams ..... 441/68
4,705,291 A * 11/1987 Gauer ..... 280/609
5,213,535 A * 5/1993 Richens, Jr. ..... 441/70
5,375,868 A * 12/1994 Sarver ..... 280/609
5,417,444 A * 5/1995 Chen ..... 280/87.042
5,667,238 A * 9/1997 Sarver ..... 280/609
5,816,592 A * 10/1998 Horton et al. ..... 280/87.041
5,823,562 A * 10/1998 Stubblefield ..... 280/609
5,927,734 A * 7/1999 Horton et al. ..... 280/87.042
5,954,356 A * 9/1999 Busby et al. ..... 280/602
6,352,268 B1 * 3/2002 Peart ..... 280/14.21
6,394,483 B2 * 5/2002 Stubblefield ..... 280/602
6,461,210 B2 * 10/2002 Lorenzo ..... 441/68
6,533,625 B1 * 3/2003 Taylor ..... 441/68
D529,565 S * 10/2006 Warner et al. ..... D21/765
7,311,166 B2 * 12/2007 Roberts et al. ..... 180/182

* cited by examiner

*Primary Examiner*—Jeffrey J Restifo
(74) *Attorney, Agent, or Firm*—Jensen & Puntigam, P.S.

(57) ABSTRACT

A snowboard which incorporates a rocker element instead of a camber.

1 Claim, 3 Drawing Sheets

SNOWBOARD

TECHNICAL FIELD

This invention relates to a snowboard, and in particular, to a snowboard which is a single board intended to be ridden by a skier, having both feet positioned on the board while gliding on the snow, wherein the distance between the zone for mounting the bindings is characterized by having an upwardly facing curve or rocker.

BACKGROUND OF THE INVENTION

Snowboarding is a sport which evolved from skiing, and therefore, the technology involved was also derived from skiing. Snowboards were initially influenced by ski manufacturers and most of the initial designers of snowboards borrowed from the accepted wisdom of the ski industry. As a consequence, there are many similarities today between skis and snowboards since both skis and snowboards are designed to travel over snow. Both skis and snowboards use essentially the same materials combined in essentially the same way. They both start with all wood constructions and then introduce synthetic materials, i.e., fiberglass, ultra high molecular weight polyethylenes, either singularly or in laminated combinations with wood cores, steel edges and plastic tops and sidewalls. The techniques of manufacture were virtually transferred unchanged from skis to snowboards. The similarities between skis and prior art snowboards are significant from the perspective of the present invention.

BEST MODE FOR CARRYING OUT THE INVENTION

Figure 1:
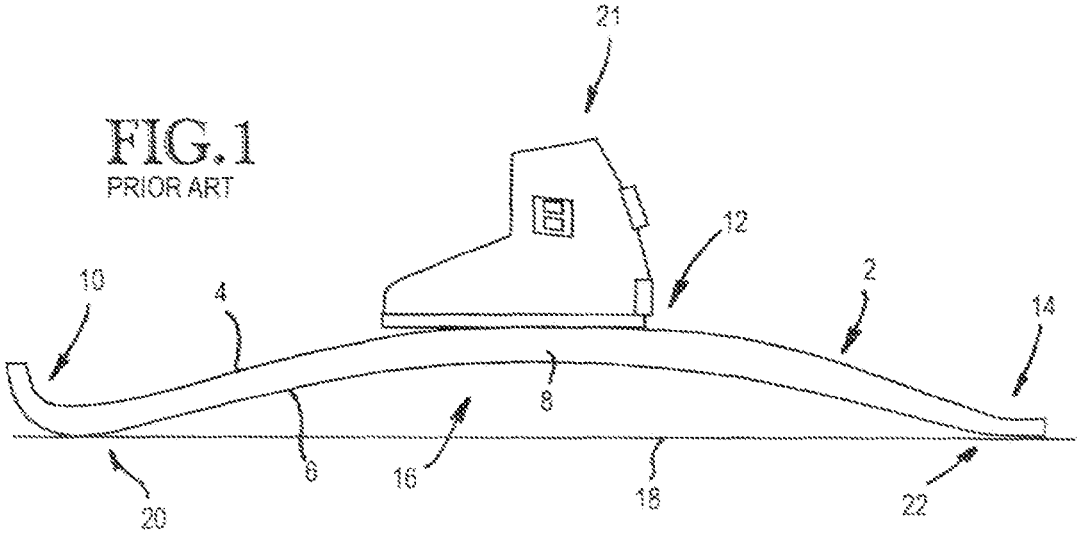
FIG.1 PRIOR ART
FIG. 1 is an exaggerated elevational view of a prior art ski.

FIG. 1 illustrates the concept of camber, the upper arching of the ski, as it is applied to prior art and to present day skis. As shown, ski 2 has a top 4 and a base 6 joined by lateral sides 8. Longitudinally, ski 2 comprises a nose 10, central section 12 and a tail 14. Nose 10 is upturned to facilitate the forward gliding of the ski over the surface of the snow. If nose 10 were flat, it would dig into the snow and cause the skier to fall. The end of the tail 14 is essentially flat, since the ski is not intended to slide in that direction. Central section 12 of ski 2 is arched upwardly, forming camber 16. The maximum height of the camber above the surface 18 is greatly exaggerated in FIG. 1, because of the camber 16 the feet 10 usually ride on snow 18 only along the two areas 20, 22 of the base 6. Camber 16 allows the ski 2 to have a certain amount of for and aft flexibility which provides the skier with better feel for the ski's contact with the snow 18. Camber 16 is also important to the steering of the skis by the skier shifting their weight, causing the weight to engage more or less of the edge 8 to be loaded, changing the deflection of the ski. Finally, because of the camber 16, ski 2 locks and acts like a leaf spring, that is, it provides a critical storage and release of energy as the skier jumps, lands and traverses uneven terrain.

As is known, only one foot, represented in FIG. 1 by boot 21 is supported more or less centrally by each ski 2. Thus ski 2 has but a single input for forces applied to the ski, namely through boot 21. Having a single camber, the distribution of those forces within the ski and therethrough to the interaction of ski and snow is straightforward and direct. As a result, the response of the ski to the forces supplied by the skier are predictable and thereby controllable and reproducible. A balanced weight distribution places the equal pressure on riding areas 20, 22; forward shifts place most of the weight on the arcuate riding area 20 adjacent the nose 10 and rearward weight shifts place most of the weight on the flat riding area 22 adjacent tail 14. Each of these weight shifts elicit a different response from the ski, even though much of the learning to ski consists of learning which weight shifts result in which response to the ski will give. Learning how to control the ski is relatively simple, because each ski has only a single input acting on a single camber.

Figure 2:
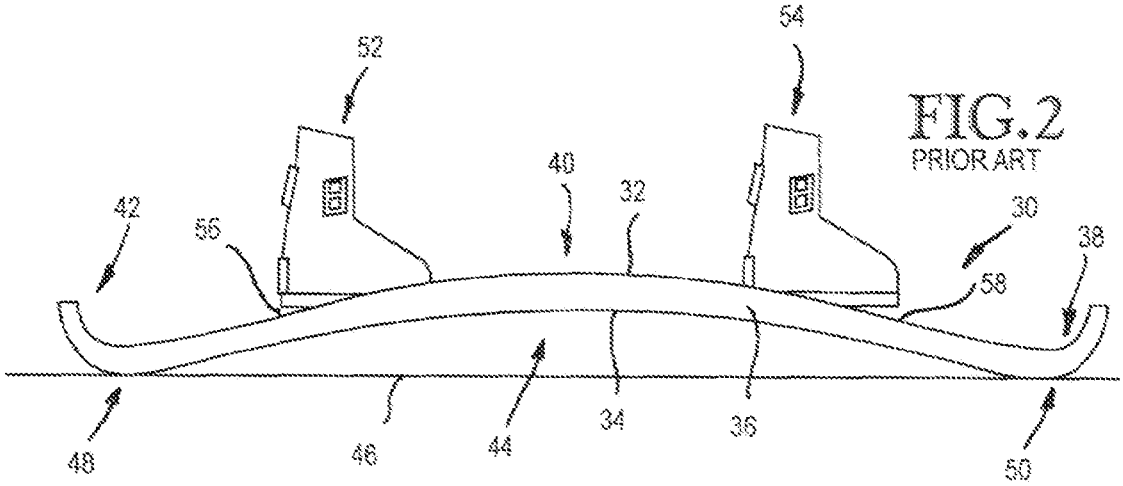
FIG.2 PRIOR ART
FIG. 2 is an exaggerated elevational view of a prior art snowboard.

FIG. 2 illustrates how prior art snowboards have incorporated ski design features therein. Snowboard 30 has a top 32, base 34 and lateral sides 36. Longitudinally, snowboard 30 comprises a nose 38, central section 40 and a tail 42 in both nose 38 and tail 42 are upturned to facilitate gliding of the snowboard in either direction over the surface of the snow. Although snowboard 30 is intended to glide forwardly over the snow, it is recognized that at times it does in fact glide backwards. For the protection of the snowboarder, tail 42 is also upturned. Some snowboards have flat tails, like ski 2, but they are in the minority and are not illustrated. Like ski 2, central section 40 of snowboard 30 is arched upwardly by a single, centrally located camber 44. As in FIG. 1, the maximum height of camber 44 above the surface 45 of the snow is greatly exaggerated in FIG. 2. Because of camber 44, snowboard 30 usually touches snow surface 46 only along 2 arcuate riding areas 48, 50 of base 34. Camber 44 is believed to be just as necessary to snowboard 30 as camber 16 is to ski 2, in that it allows snowboard 30 to have for and aft flexibility which provides a better feel for the snow, better control of the snowboard by shifting of the skier's weight and effective shock absorption.

Unlike ski 2, wherein a single boot 20 is attached to the top 4, a pair of boots, 52, 54 are attached to the top 32 of snowboard 30 in two extended mounting zones 56, 58. As is well known in the art, each boot is secured by bindings which are threadedly attached to internally threaded inserts recessed into the top 32.

In an attempt to alleviate some of the problems of the prior art of FIG. 2, a snowboard 60 was devised as a top 62, bottom 64 and sides 66. This board also includes a front end 68, rear end 70 and a center portion 72. It is to be noted that this snowboard includes two cambers 74, 76 each between the center 72 and the fore or aft portion 68, 70. Thus, placing the boots 78, 80 directly over the camber 74, 76, causing the snowboard to in theory react more like the ski of Figure, in that the downward pressure is over the camber for each boot, causing the board to flex downwardly and likewise having three contact points, 82, 84, 86 with the snow surface 88.

DISCLOSURE OF THE INVENTION

Figure 3:
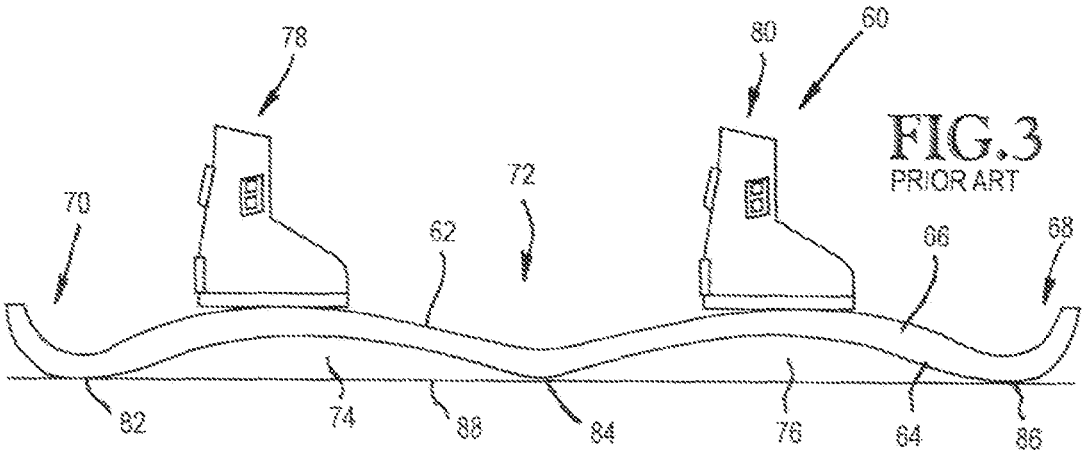
FIG.3 PRIOR ART
FIG. 3 is an exaggerated elevational view of a different prior art snowboard.
Figure 4:
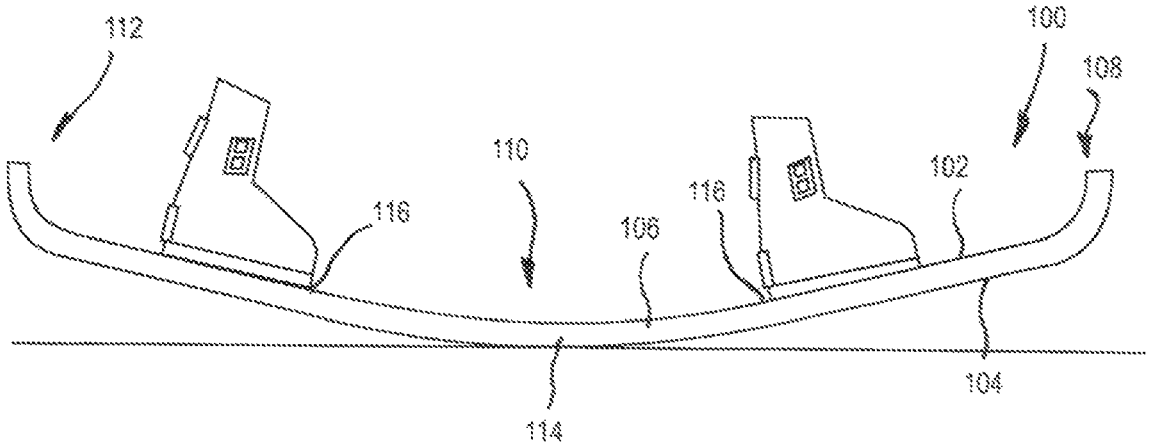
FIG. 4 is an exaggerated elevational view of the present invention.
Figure 6:
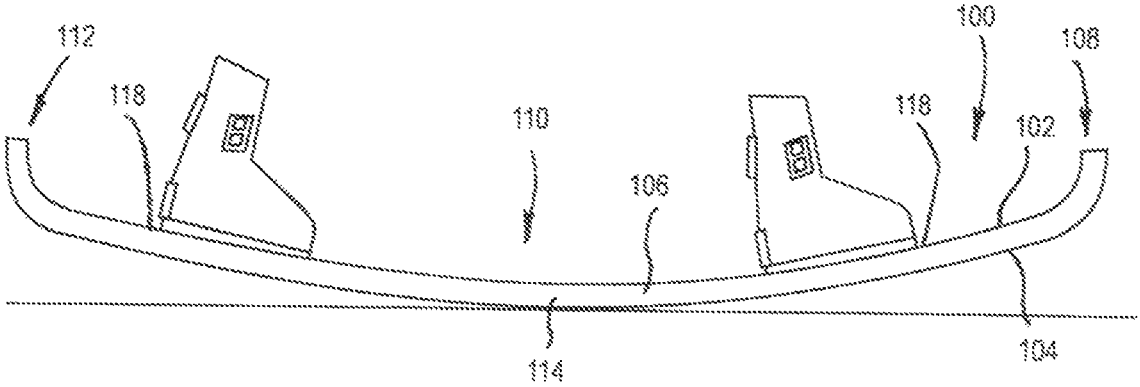
FIG. 6 is an exaggerated elevational view of a second embodiment of the present invention.

Reference is now had to FIGS. 4 and 6 wherein the current invention is illustrated and identical numbers will be used to identify common elements. As was the case in FIGS. 1-3, the contour of the board is exaggerated to more clearly illustrate the differences over the prior art. Snowboard 100 has a top 102, bottom 104 and sides 106, has front 108, center portion 110 and rear or aft 112. Contrary to the previous concepts and prior art, the inventive snowboard does not includes a camber, but instead includes a downwardly projecting rocker 114 which in FIG. 4 extends to the innermost end of the binding securement zone 116, and in FIG. 6 extends to the outermost end of the binding securement zone 118, it being understood that the exact length of the rocker portion is not definitive of the present invention, but that the concept of eliminating the camber and replacing it with a rocker which greatly improves the operation of the snowboard, in that when carving a turn, whether in soft snow or on hard-paced snow or ice presents more of the edge portion to the supporting snow and enables a more controlled curve. Further, when the snowboard is unweighted, the end portions spring upwardly, greatly reducing the possibility of hooking an edge, resulting in a fall.

Figure 5:
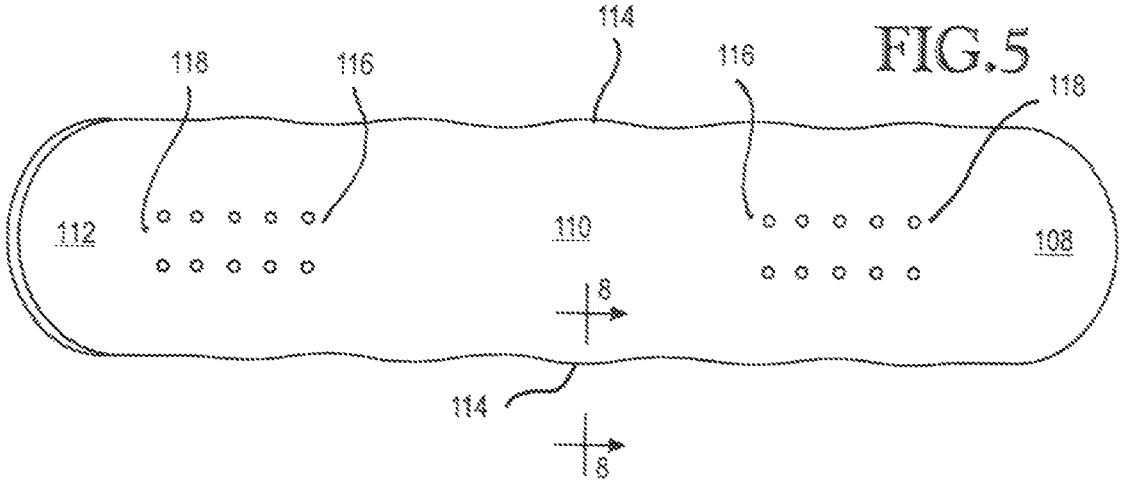
FIG. 5 is a plan view of the present invention.

As seen in FIG. 5, the snowboard 100 includes a plurality of preboard, pre-threaded holes between the designations 116, 118, hereinafter referred to as the binding attachment zones for securing the binding to the board.

Also to be noted in this figure is that the sides 114 are undulated as disclosed in co-pending application Ser. No. 10/966,129, having a common assignee.

It is to be understood that empirically the combination of the rocker and the undulated edge yields a much more responsive snowboard.

Figure 7:
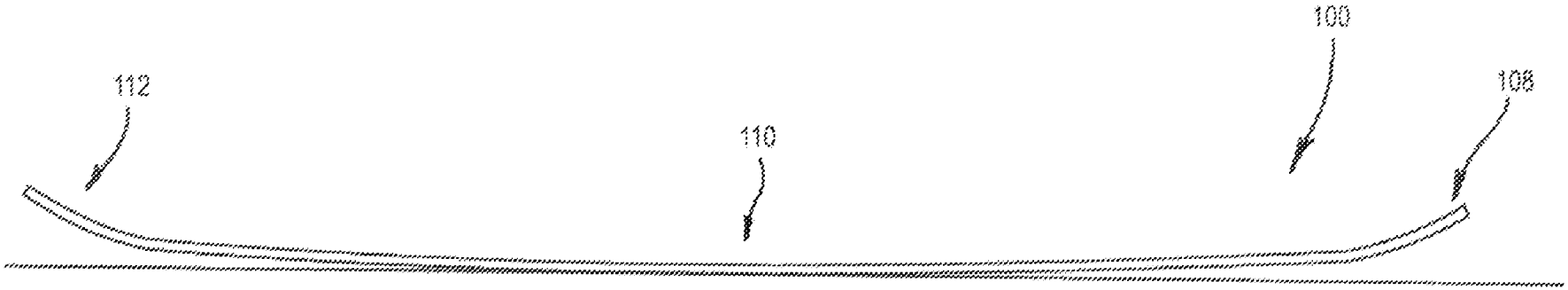
FIG. 7 is an elevational view of the present invention.
Figure 8:
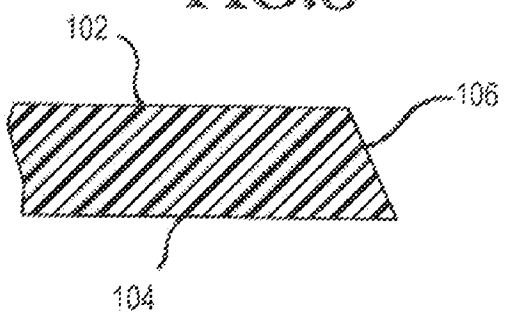
FIG. 8 is a partial sectional view depicting the edge of the present invention.

FIG. 7 illustrates the inventive snowboard in a non-exaggerated elevational view.

FIG. 6 illustrates the fact that edge 106 of the snowboard extending between the top 102 and the bottom 104 is not perpendicular to the top and bottom but in fact slopes outwardly toward the bottom increasing the cutting edge.

The invention claimed is:

1. A snowboard, comprising:

a nose portion, a tail portion, a uniform base surface, a top surface, a central section extending between an intermediate nose section and an intermediate tail section and a pair of mounting zones on said top surface to mount a pair of boots to said intermediate sections, said central section bowed downwardly and said intermediate sections planer so that the respective intermediate sections are deflected downwardly toward the riding surface when in use and move upwardly during an offloading maneuver and the nose and tail portion curve upwardly at a smaller radius than the central section.

* * * * *